US005617683A

United States Patent [19]

Ney

[11] Patent Number: 5,617,683

[45] Date of Patent: Apr. 8, 1997

[54] SHUTTER PANEL

[76] Inventor: Theodore K. Ney, 9089 W. Shaddock Rd., Fort Myers, Fla. 33912

[21] Appl. No.: 621,523

[22] Filed: Mar. 25, 1996

[51] Int. Cl.[6] ..... E06B 3/26

[52] U.S. Cl. ..... 52/202; 52/309.9; 52/783.13; 52/800.12; 52/794.1; 49/501

[58] Field of Search ..... 52/309.9, 203, 52/783.12, 783.13, 783.17, 784.15, 794.1, 800.12, 800.13, 454, 202; 49/501

[56] References Cited

U.S. PATENT DOCUMENTS

| | | | |
|---|---|---|---|
| 3,934,382 | 1/1976 | Gartung | 52/800.12 X |
| 3,971,867 | 7/1976 | Randall | 52/800.12 X |
| 4,263,752 | 4/1981 | Jungbluta | 52/783.13 X |
| 4,368,594 | 1/1983 | Milam et al. | 52/202 X |
| 5,430,982 | 7/1995 | Bane | 52/202 |

FOREIGN PATENT DOCUMENTS

| | | | |
|---|---|---|---|
| 920021836 | 12/1992 | WIPO | 52/794.1 |

*Primary Examiner*—Carl D. Friedman
*Assistant Examiner*—Yvonne Horton-Richardson
*Attorney, Agent, or Firm*—Merrill N. Johnson

[57] ABSTRACT

An improved shutter panel designed to fit over window openings in the advent of high winds or driving rains and thereby protect against glass breakage and water damage. The shutter panel is bounded by a rectangular frame made of U-shaped metal channels, which houses a centrally located steel sheet having a series of spaced apart parallel V-shaped grooves and a pair of sheets of extruded polystyrene designed to lie against the opposite sides of the steel sheet. A sheet of woven plastic netting is spread over the outermost surfaces of the two sheets of polystyrene and then a layer of stucco is troweled over each sheet of netting and allowed to air dry, creating a strong light weight shutter panel.

3 Claims, 1 Drawing Sheet

FIG. 1
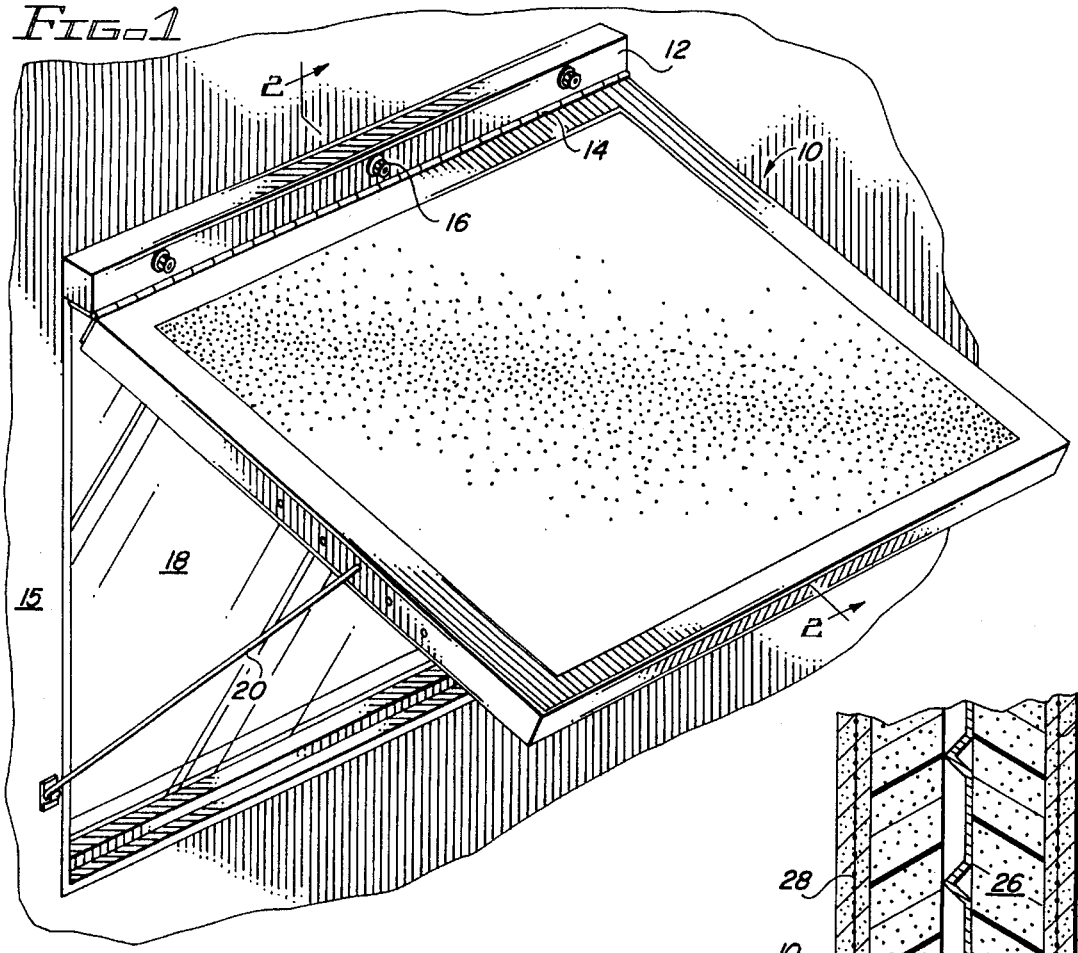
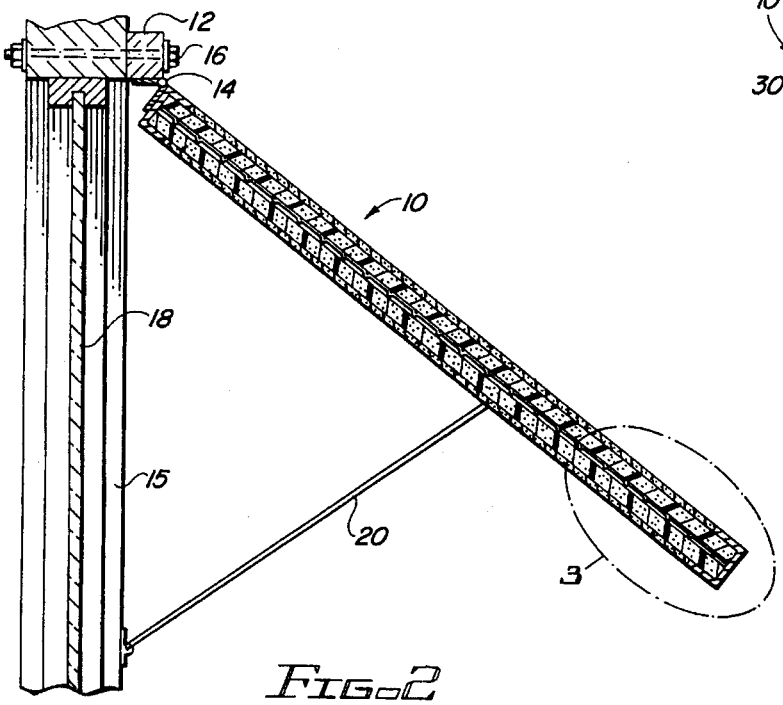
FIG. 2
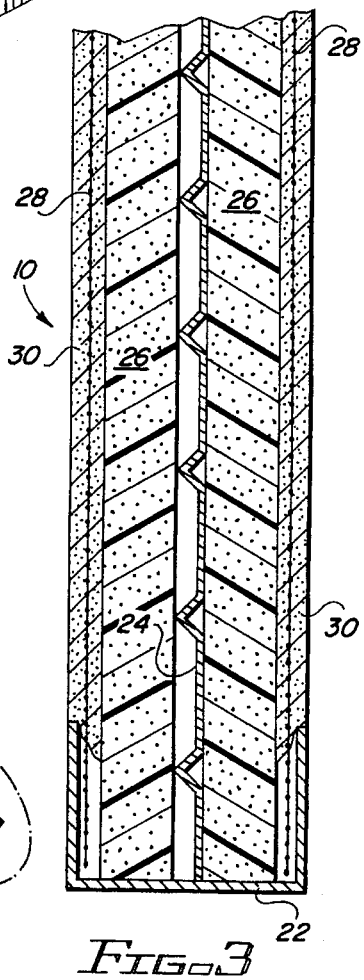
FIG. 3

SHUTTER PANEL

BACKGROUND OF THE INVENTION

Shutters which in fair weather lie adjacent to a window opening are usually hung so that in inclement weather the shutter can be moved to cover the window opening to shield it from high winds and driving rains. Various arrangements have been and are being used to move the shutter panel into position where it covers and protects the window opening from wind and rain.

Perhaps the most common arrangement is to mount the shutter panel on hinges beside the window opening or alternatively to split the shutter into two similar halves mounted on hinges on opposite sides of the window opening. Then upon a forecast of high winds and/or rain, the shutter panel or pair of shutter panels can be swung 180° and locked into position to shield the window and its opening from the impending storm.

Another popular arrangement is the Bahama shutter which is hung from one or more hinges located directly above the window opening. In fair weather, the shutter panel is maintained at an angle of about 45° below horizontal to serve as a sun shade over the window opening by a pair of rods whose opposite ends are located in slots on the building wall and in the opposite edges of the shutter panel. On the approach of high winds or driving rain, the rods are removed and the shutter panel will swing down to completely cover the window opening where it is locked into position.

Shutter panels are made from a wide variety of materials including natural and processed wooden sheets and panels, rolled aluminum and steel sheets, aluminum and plastic extruded channels and other shapes, and flat and molded panels made of various plastic materials.

BRIEF DESCRIPTION OF THE INVENTION

I have invented an improved shutter panel which is more rugged and better able to withstand hurricane force winds and yet can be built at less cost per square foot than most shutters presently on the market.

My shutter panel is attractive and its outer surface made to match the color and style of the exterior of the building from which the shutter is hung.

Briefly put, the shutter has a rectangular frame made of U-shaped metal channels of the type conventionally used as studs in the walls of buildings. The flat center section of the channels form the four outer edges of the panel. The frame houses a multi-layered assembly of components, all of which are readily available at most hardware stores and building material warehouses.

The components include at the center of the panel a sheet of galvanized steel about ⅜" thick and contains a series of parallel V-shaped grooves stamped into the sheet which strengthens and stiffens the panel and prevents the sheet from being bent. Lying against the opposite sides of the steel sheet are two similar rectangular sheets of extruded polystyrene having the same outer dimensions as the steel sheet. Preferably the two extruded polystyrene sheets each have a thickness of one inch.

A sheet of netting or screening lies against the side of each polystyrene sheet which is not pressed against the steel sheet. Preferably the sheet of screening is made of nylon.

A layer of finish stucco is troweled over each sheet of screening to cover the screening and the polystyrene sheet which when dry forms a decorative finish on both sides of the shutter panel. The stucco can be colored and finished to match the color and appearance of the exterior surface of the building wall to which the shutter is attached.

BRIEF DESCRIPTION OF THE DRAWINGS

FIG. 1 is a perspective view of a Bahama shutter made in accordance with my invention showing the shutter in its open position serving as a sun shade for the window opening.

FIG. 2 is a cross-sectional view showing my multi-layered shutter panel taken along line 2—2 of FIG. 1.

FIG. 3 is a cross-sectional view showing the construction of the lower portion of the multi-layered shutter panel within line 3 of FIG. 2.

DETAILED DESCRIPTION OF THE PREFERRED EMBODIMENT

FIGS. 1 and 2 of the drawings portray one of the many ways my shutter panel 10 can be mounted adjacent a window opening in fair weather and upon a forecast of stormy weather be easily moved over the window opening to shield the window from wind and rain.

Shutter panel 10 in FIGS. 1 and 2 is a Bahama shutter hung from an elongated header 12 by hinge 14. The header is affixed to exterior building wall 15 by three bolts 16. Header 12 lies directly above window 18 as best shown in FIG. 1.

Shutter panel 10 is shown in its fair weather position, lying at an angle of about 45° below horizontal serving as a sun screen to prevent bright sun from shining directly through window 18. Shutter 10 is held in place by a pair of removable steel rods 20 whose opposite ends fit onto brackets on building wall 15 and in holes on the opposite sides of shutter 10.

Upon receiving a storm warning, rods 20 are removed and shutter 10 will swing down into a vertical position where it is locked into position covering the window opening and shielding window 18 from damage by the storm.

FIG. 3 is a cross-sectional view of shutter panel 10 showing its multi-layer construction. The panel is bounded by a rectangular metal frame 22 of U-shaped channels. At the center of panel 10 is a rectangular galvanized steel sheet 24 having a series of parallel V-shaped channels to provide strength and rigidity to the panel and prevent the sheet from creasing or bending.

Two rectangular sheets 26 of extruded polystyrene preferably about one inch thick lie against the opposite sides of the steel sheet. The outer dimensions of polystyrene sheets 26 approximate the outer dimensions of the steel sheet.

A sheet of preferably nylon netting or screening 28 is laid against the surface of the side of each polystyrene sheet 26 which is not in contact with steel sheet 24. A layer of wet finish stucco 30 is troweled over the sheets of plastic screening 28 to completely cover the screening and the polystyrene sheets. The troweled stucco 30 when dry forms a desirable decorative finish to both sides of the shutter panel. Finish stucco is a mixture of portland cement, silica sand, hydrated lime, vinyl acetate polymer and water which is widely used to form the exterior surfaces of buildings in Florida and other sunbelt regions. If desired, stucco 30 can be colored and finished to match the appearance of the exterior surfaces of the building.

While I have shown and described a preferred embodiment of my shutter panel, such disclosure should not be viewed as limiting the scope or breadth of my invention. The scope of my invention is defined only by the appended claims.

I claim:

1. A shutter panel for protecting window openings comprising a rectangular frame made of U-shaped metal channels, the flat center portion of the channels forming the outer edges of the panel, said frame enclosing a multi-layered assembly of components which include a center sheet of metal having spaced apart parallel V-shaped grooves stamped into the sheet to increase the rigidity of the sheet, two sheets of extruded polystyrene lying against the opposite sides of the metal sheet, two sheets of screening each lying against the side of a sheet of extruded polystyrene remote from the center metal sheet, and a layer of exterior finish stucco troweled over each of the two sheets of screening and the sheets of extruded polystyrene to form when dry the surfaces of the shutter panel, each of said components being sized to fit within the rectangular metal frame.

2. A shutter panel as set forth in claim 1 in which the metal sheet is galvanized steel having a thickness of about three eighths of an inch.

3. A shutter panel as set forth in claim 1 in which the two sheets of extruded polystyrene each have a thickness of about one inch.

* * * * *